United States Patent [19]

Chen et al.

[11] 3,974,246

[45] Aug. 10, 1976

[54] METHOD OF IMPROVING THE MAGNETIC PROPERTIES OF COBALT SUBSTITUTED MAGNETITE

[75] Inventors: Shih-Lu Chen; James A. Murphy, both of Painted Post, N.Y.

[73] Assignee: Corning Glass Works, Corning, N.Y.

[22] Filed: Feb. 11, 1974

[21] Appl. No.: 441,130

Related U.S. Application Data

[62] Division of Ser. No. 257,335, May 26, 1972, Pat. No. 3,859,129.

[52] U.S. Cl. ..... 264/24; 252/62.55; 252/62.56; 264/61; 264/DIG. 58

[51] Int. Cl.[2] ..... B06B 1/02

[58] Field of Search ..... 264/61, DIG. 58, 24; 252/62.55, 62.56

[56] References Cited

UNITED STATES PATENTS 3,700,500 10/1972 Rodbell et al. ..... 264/DIG. 58

3,748,270 7/1973 Hwang ..... 252/62.56

*Primary Examiner*—Donald J. Arnold
*Assistant Examiner*—John Parrish
*Attorney, Agent, or Firm*—Walter S. Zebrowski; Clarence R. Patty, Jr.

[57] ABSTRACT

A method of improving the magnetic properties of cobalt substituted magnetite by magnetizing the material to the saturation level in the desired direction, and then removing the magnetizing field. The material will retain a level of magnetization normally referred to as the remanent state of magnetization or simply remanence. The magnetized material is then subjected to a heat treatment to anneal the material. The above process significantly improves coercivity, hysteresis loop squareness ratio, and resistance to remanence loss due to external forces.

11 Claims, 10 Drawing Figures

PARALLEL loop $\theta_r = 0.0915$ MAX/CM
$\theta_r/\theta_{10K} = 0.682$
$H_c = 490$ Oe PERPENDICULAR loop $\theta_r = 0.0885$ MAX/CM
$\theta_r/\theta_{10K} = 0.66$
$H_c = 434$ PARALLEL loop $\theta_r = 0.0915$ MAX/CM
$\theta_r/\theta_{10K} = 0.682$
$H_c = 490$ Oe PERPENDICULAR loop $\theta_r = 0.0885$ MAX/CM
$\theta_r/\theta_{10K} = 0.66$
$H_c = 434$ PARALLEL loop $\theta_r = 0.0645$ MAX/CM
$\theta_r/\theta_{10K} = 0.64$
$H_c = 730$ Oe PERPENDICULAR loop $\theta_r = 0.061$ MAX/CM
$\theta_r/\theta_{10K} = 0.615$
$H_c = 610$ Oe

METHOD OF IMPROVING THE MAGNETIC PROPERTIES OF COBALT SUBSTITUTED MAGNETITE

CROSS-REFERENCE TO RELATED APPLICATION

This is a division of application Ser. No. 257,335 filed May 26, 1972, now U.S. Pat. No. 3,859,129.

BACKGROUND OF THE INVENTION

1. Field of the Invention

This invention relates to a method of improving the magnetic properties of cobalt substituted magnetite by inducing uniaxial anisotropy in the material in addition to the already present cubic anisotropy. Magnetic recording and storage devices having a film of cobalt substituted magnetite may be used for storing digital information used by data processing computers, or any other analog or digital information where magnetic storage is desired.

2. Description of the Prior Art

It is known by those skilled in the art that heating cobalt substituted magnetite material to an elevated temperature less than the Curie temperature of the material while the material is being subjected to a magnetic field will result in a uniaxial anisotropy being induced in the material in the direction of the magnetic field. The magnetic field applied during heating of the material does not directly induce the resulting uniaxial anisotropy of the material, but merely aligns the magnetization of each crystal or each domain in substantially the same direction. It is understood that when the material is subjected to an elevated temperature less than the Curie temperature, a uniaxial anisotropy is induced in each crystal of a polycrystalline material or each domain of a single crystal whether or not a magnetic field is applied. If the magnetic field is not applied, the uniaxial anisotropy of each crystal or domain is induced in a random direction. The uniaxial anisotropy superimposes itself on the normal cubic anisotropy. Additional information on this phenomena is available in the following publications: Physical Review, Volume 99, page 1788, 1955, by R. M. Bozorth, E. F. Tilden, and A. J. Williams; Proceedings of the Institute of Electrical Engineering, London, Volume 104, Part B — Supplement 7, page 412, 1957, by Wijn, Van der Heide, and Fast; Journal of the Physical Society of Japan, Volume 13, page 58, 1958, by Shuichi Lida, Hisashi Sekizawa, and Yoshimichi Siyama; Physical Review, Volume 108, page 271, 1957, by R. F. Penoyer and L. R. Bickford, Jr.; and Journal of Applied Physics, Volume 29, page 441, 1958, by L. R. Bickford, Jr., J. M. Brownlaw and R. F. Penoyer.

Cobalt substituted magnetite materials have previously been used in the fabrication of some types of magnetic devices such as permanent magnets. The magnetic qualities of such devices have been improved by heating them to an elevated temperature below the Curie temperature while they were subjected to a magnetic field. However, using such a technique to improve the magnetic qualities of magnetic recording and storage devices is made very difficult, if not impossible, by practical considerations since magnetic recording and storage devices are ordinarily in the shape of a tape, drum, rod or disk. To improve the magnetic properties of a drum shaped device, for example, the uniaxial anisotropy must be oriented circumferentially around the drum axis along the cylindrical walls, and to improve the magnetic properties of a disk shaped device the uniaxial anisotropy must be oriented circularly around the axis on the disk surface. Providing magnetic fields to achieve the desired orientation of the uniaxial anisotropy of such devices while they are being heat treated presents very difficult practical problems.

SUMMARY OF THE INVENTION

It is therefore, an object of this invention to provide a method of inducing uniaxial anisotropy having a desired orientation in a cobalt substituted magnetite material.

It is a further object of this invention to provide a simple and economical method of inducing uniaxial anisotropy having a desired orientation in a magnetic recording and storage device employing cobalt substituted magnetite material as the storage medium, which method overcomes the heretofore noted disadvantages.

Briefly, according to this invention magnetic properties such as coercivity, hysteresis loop squareness ratio, and resistance to loss or remanence due to abrasion and other external forces may be significantly improved in magnetic devices having cobalt substituted magnetite as the magnetic material by magnetizing the material to the saturation level in a desired direction, and then removing the magnetizing field. The material will retain a level of magnetization normally referred to as remanence. The magnetized material is then subjected to a heat treatment to anneal the material.

Additional objects, features and advantages of the present invention will become apparent to those skilled in the art from the following detailed description and attached drawings.

DETAILED DESCRIPTION

Figure 1:
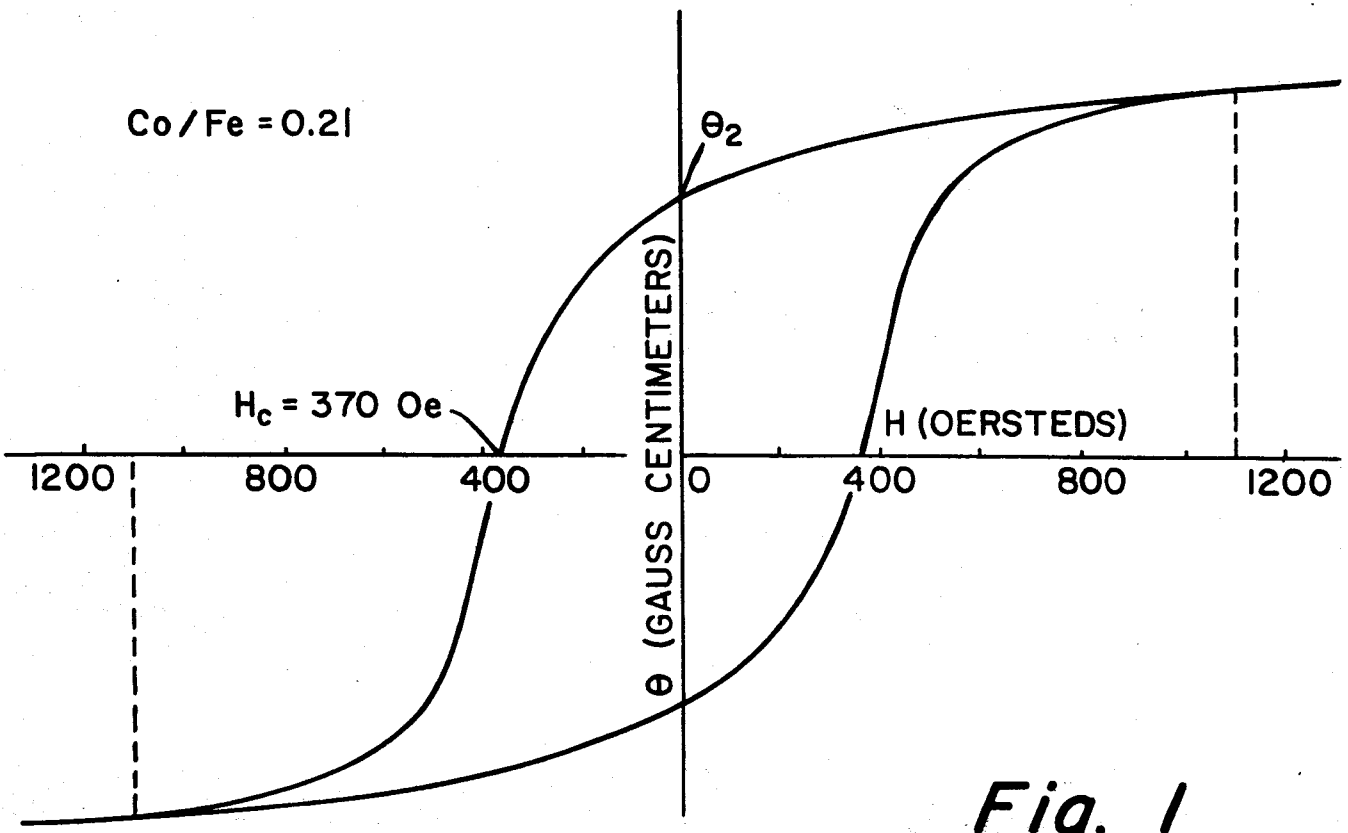
Fig. 1 (PRIOR ART)
FIG. 1 is a diagram showing the major hysteresis loop of a device having a cobalt substituted film which has not been improved by the method of the present invention.

A magnetic recording and storage device is formed having a non-magnetic substrate to which a magnetic film containing cobalt substituted magnetite is bonded. As used herein, the term "cobalt substituted magnetite" means a magnetic material having a cubic crystalline structure, similar to the crystalline structure of magnetite ($Fe_3O_4$) in which cobalt, iron and oxygen are combined according to the formula $Co_xFe_{3-x}O_4$. The magnetic properties of cobalt substituted magnetite may be improved by treating the material according to the method of the present invention for amounts of cobalt in the film, represented by $x$ in the formula $Co_xFe_{3-x}O_4$, varying from a low value of about 0.1 to a high value of about 1.2. Since it is inconvenient to indicate the amount of cobalt in magnetite by referring to the value of $x$, such amount is herein indicated by the "cobalt to iron ratio," or simply Co/Fe. The cobalt to iron ratio is related to $x$ by the equation $Co/Fe = x/3-x$. For example, where $x$ equals 0.1, $$Co/Fe = \frac{0.1}{3-0.1}$$

or 0.0345; and where $x$ equals 1.2, $$Co/Fe = \frac{1.2}{3-1.2}$$

or 0.665. Although films having a Co/Fe between a low value of about 0.0345 and a high value of about 0.665 may be improved by the method of this invention, the most significant improvement occurs in films having a Co/Fe of between about 0.1 and 0.25.

The substrate or support member may have any suitable form such as a tape, disk, rod, drum or the like, and may be formed from any suitable non-magnetic material that can withstand the temperatures encountered in the method of this invention without damage. Examples of such materials are vinyls, plastics, anodized aluminum, glass-ceramic, glass, ceramic and the like. The present invention is not limited to any specific substrate material. For magnetic devices not requiring a highly flexible substrate, a particularly suitable material for forming a disk, rod, drum or the like is ion-exchange strengthened glass or glass-ceramic. A basic discussion of ion-exchange strengthening processes is found in "Stresses in Glass Produced by Non-Uniform Exchange of Monovalent Ions" by S. F. Kistler, published in the Journal of the American Ceramic Society, February 1962, pages 59–68.

The magnetic film containing cobalt substituted magnetite may be a solid non-particulate film chemically bonded to the substrate, or may be particles of the cobalt substituted magnetite material bonded to each other and to the substrate by binder or filler materials such as epoxies, urethanes, vinyls, and the like. Techniques for fabricating magnetic devices from binders and magnetic particles are well known to those skilled in the art. However, additional information concerning such techniques may be found in the following U.S. patents: U.S. Pat. No. 2,989,415 entitled "Magnetic Recording Medium and Method of Making the Same," issued to Paul V. Horton and Robert S. Haines; U.S. Pat. No. 3,015,628 entitled "Ferroso-Ferric Oxide for Magnetic Impulse Record Members" issued to Joseph W. Ayers and Robert A. Stephens; U.S. Pat. No. 3,047,505 entitled "Magnetic Recording Media" issued to Arthur Miller; and U.S. Pat. No. 3,330,693 entitled "Method of Making a Magnetic Record Member with Encapsulated Ferromagnetic Particles in a Binder and Resulting Product" issued to George C. Rumberger. Techniques for fabricating devices having a solid non-particulate magnetic film chemically bonded to a substrate, although available, are not as well known. However, information concerning such techniques may be found in U.S. Pat. No. 2,919,207 entitled "Method of Applying a Ferromagnetic Surface to a Base Utilizing Iron Carbonyl and Oxygen" issued to Karl Scholzel, and in the two patent applications entitled "Method of Making a Magnetic Recording and Storage Device" by James A. Murphy, Sami A. Halaby and Neal S. Kenny, Ser. Nos. 151,356 and 151,388, both filed on June 9, 1971 and now U.S. Pat. Nos. 3,795,542 and 3,892,888 respectively. A method of producing a cobalt substituted magnetite magnetic film chemically bonded to the substrate which is particularly suitable for the present invention is as follows.

The vapors of an iron containing compound that will not decompose when vaporized, and the vapors of a cobalt containing compound that will not decompose when vaporized are transported to a heated substrate where the vapors are allowed to react. Such iron and cobalt containing compounds include but are not limited to those shown in Table I. The vapors of any of the iron containing compounds listed in Table I may be satisfactorily used with the vapors of any of the cobalt containing compounds listed in Table I.

Table I

| Cobalt Containing Materials | Iron Containing Materials |
|---|---|
| cobalt nitrosyltricarbonyl $Co(CO)_3NO$ | iron pentacarbonyl - $Fe(CO)_5$ |
| cobaltocene -$Co(C_5H_5)_2$ | ferrocene - $Fe(C_5H_5)_2$ |
| cobaltic acetylacetonate 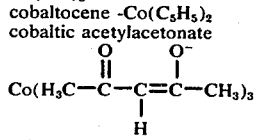 | ferric acetylacetonate 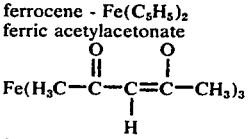 |
| cobaltous acetylacetonate 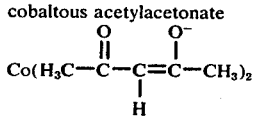 | ferrous acetylacetonate 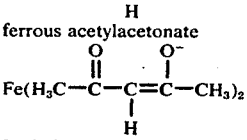 |
| cobaltic hexafluoroacetylacetonate 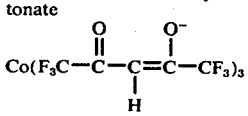 | ferric hexafluoroacetylacetonate 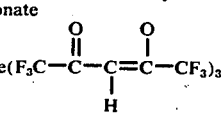 |
| cobaltous hexafluoroacetylacetonate 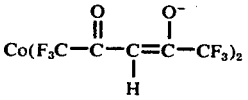 | ferrous hexafluoroacetylacetonate 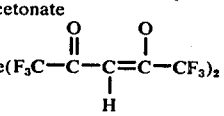 |

In addition, the iron containing compound ferric chloride ($FeCl_3$) may satisfactorily be used with the cobalt containing compound cobalt chloride ($CoCl_2$).

Depending upon the cobalt containing compound and iron containing compound used, the temperature of the substrate upon which said vapors are allowed to react may be varied from about 200°C to an upper limit determined by structural limitations of the substrate. However, in most cases the desirable range will be from about 350°C to about 550°C. The film resulting from the reaction of the vapors on the heated substrate is a non-magnetic cobalt-iron oxide. The non-magnetic cobalt-iron oxide film is then reduced to a magnetic cobalt substituted magnetite material by subjecting the substrate and non-magnetic cobalt-iron oxide film to a suitable reducing atmosphere, such as a hydrogen and water atmosphere. The reduction is accomplished by heating the film and substrate combination to a temperature of between 300°C and a maximum temperature determined by structural limitations of the substrate while maintaining the combination in a reducing atmosphere.

Atmospheres particularly suitable for use in this invention include but are not limited to a hydrogen and water mixture, a carbon monoxide and carbon dioxide mixture, and a carbon monoxide and water mixture. An inert gas, such as nitrogen, may be combined with these reducing atmospheres without significantly reducing the effectiveness thereof. An atmosphere of hydrogen and water in combination with nitrogen, which is particularly suitable for use with the method of this invention, may be obtained by bubbling a mixture of hydrogen and nitrogen through water. The important consideration of this particular atmosphere is the hydrogen partial pressure to water partial pressure ratio. The nitrogen is substantially inert and acts only as a carrier gas for the water so that the ratio of hydrogen to water in the system is more easily controlled. The allowable range of hydrogen partial pressure to water partial pressure ratio which will produce the desired atmosphere for converting the non-magnetic cobalt-iron oxide will vary as the temperature of the film and substrate combination varies. A hydrogen partial pressure to water partial pressure ratio range of between 5:1 and $10^{-4}$:1 may be used for temperatures between about 300°C and about 600°C. Atmosphere temperatures greater than 600°C may be used if the ratio is maintained between about $10^{-1}$:1 and $10^{-4}$:1. After reduction is completed, the temperature of the film and substrate should be reduced to less than about 200°C in the shortest possible time to achieve the highest improvement as a result of the present method.

The magnetic device as described is subjected to a magnetic field to magnetize the film in the desired direction to substantially the saturation level of the material. The magnetic field strength required to magnetize the device to the saturation level will depend upon the magnetic properties of the device. For example, FIG. 1 shows the major hysteresis loop of an untreated cobalt substituted magnetite film having a cobalt to iron ratio of about 0.21. Symbol $\theta$ represents the magnetic flux in the material times the film thickness, hereinafter referred to simply as magnetization, which magnetization is brought about by the applied field. In FIG. 1, magnetization $\theta$ is in gauss centimeters and the applied field H is in oersteds. From FIG. 1, it can be seen that the maximum remanence is obtained with an applied magnetic field of about 1100 oersteds since that is the field necessary to magnetize the film to substantially saturation. As can also be seen from FIG. 1, the coercivity $H_c$ of such a film is approximately 370 oersteds. As heretofore noted, the field necessary for saturation will vary dependng upon the magnetic properties of the device, however, as a practical matter an external field of between 4000–7500 oersteds may be satisfactorily used for many of the described devices since an excessive field will do no harm whereas an insufficient field will result in an unnecessarily low remanence and, consequently, the improvement as a result of the process of this invention will not be as great as possible. After the external magnetic field has been removed the remanent magnetization in the device aligns the uniaxial anisotropy in the cobalt substituted magnetite film in the same direction thereby eliminating the need for an external field to be applied while the device is undergoing the extreme temperatures encountered during annealing.

In employing the method of the present invention, the device can be magnetized in the desired direction a portion at a time by any suitable means, including the apparatus normally used to record on the magnetic device. For example, magnetic disks may be magnetized substantially to saturation by applying a continuous DC signal to the recording head while rotating the disk in the normal manner in relation to the head. More specifically, the head may be positioned over one track and the disk rotated a full revolution thereunder in the normal manner. The head would then be repositioned over an adjacent track and the disk again rotated a full revolution. This procedure would be continued until all of the tracks of the disk are completely magnetized in the desired direction. Magnetic recording and storage devices having other shapes could similarly be magnetized by the device utilization means. Obviously, equipment specially built for this purpose can also be used.

After the desired remanence and alignment is obtained, the device is heat treated to anneal the cobalt substituted magnetite film. Such heat treatment may be satisfactorily carried out in air, but any atmosphere not reactive with the cobalt substituted magnetite or with the substrate material at the annealing temperature may be used. The time necessary for proper annealing varies with temperature and the cobalt to iron ratio. High temperatures require less annealing time and low temperatures require more annealing time. However, it has been found that satisfactory results may be obtained even when the device is annealed for a period of time well in excess of that which is necessary. Good results have been obtained when time period ranged from two hours to 177 hours for temperatures between about 200°C and 95°C respectively. If the temperature is below about 95°C, annealing is so slow that the total required time is excessive and therefore unsatisfactory. On the other hand, if the temperature is above about 200°C, process control becomes more difficult, and the results become less predictable since the cobalt substituted magnetite begins to become chemically unstable and may convert to a non-magnetic oxide. It has been found that excellent and consistent results can be obtained by using a temperature of between about 150°C and 160°C for a time period of about 147 hours.

Figure 2:
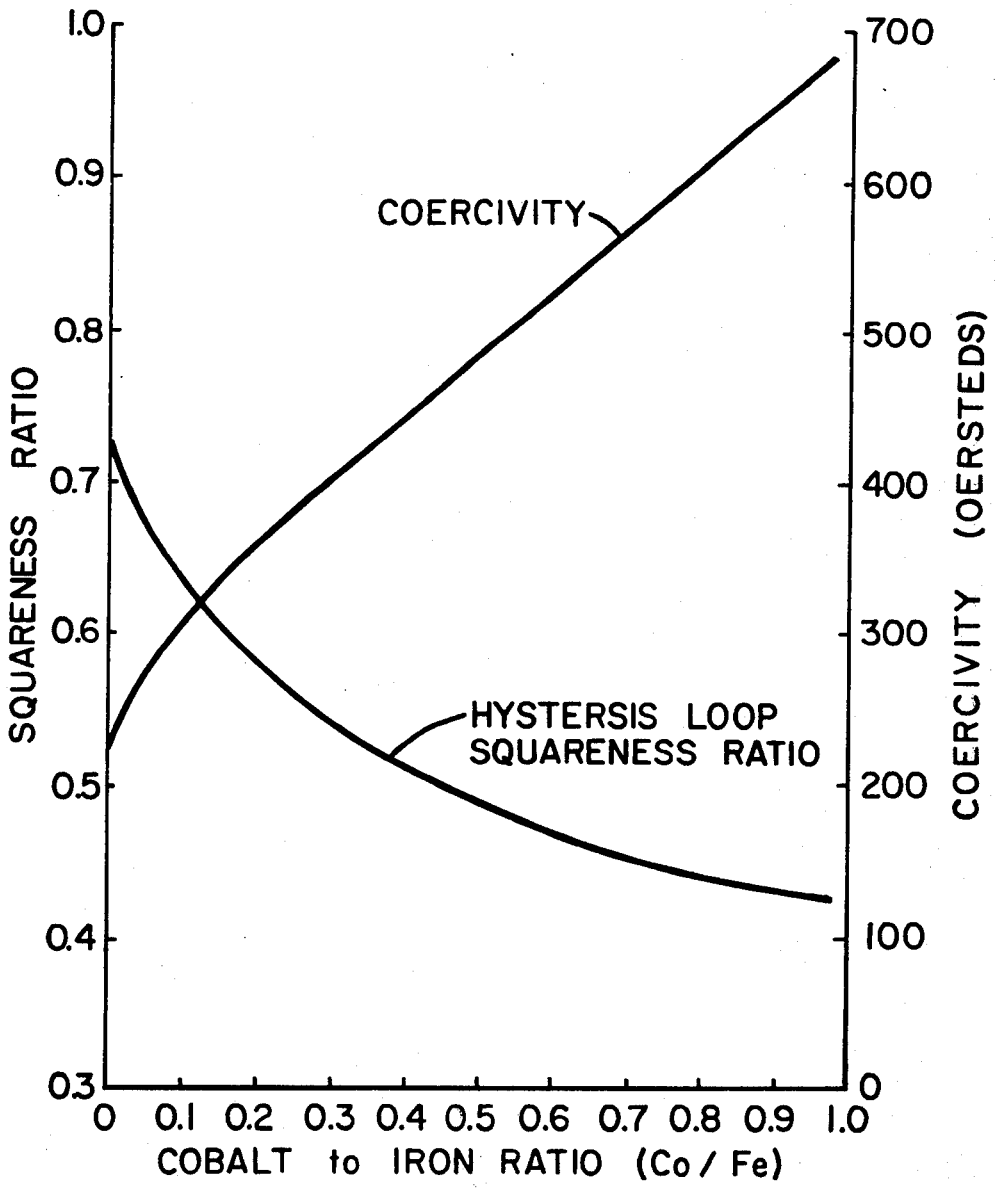
Fig. 2 (PRIOR ART)
FIG. 2 is a diagram showing the effect of variations in the cobalt to iron ratio upon the coercivity and the hysteresis loop squareness ratio of a magnetic device having an unimproved cobalt substituted magnetite film.
Figure 3:
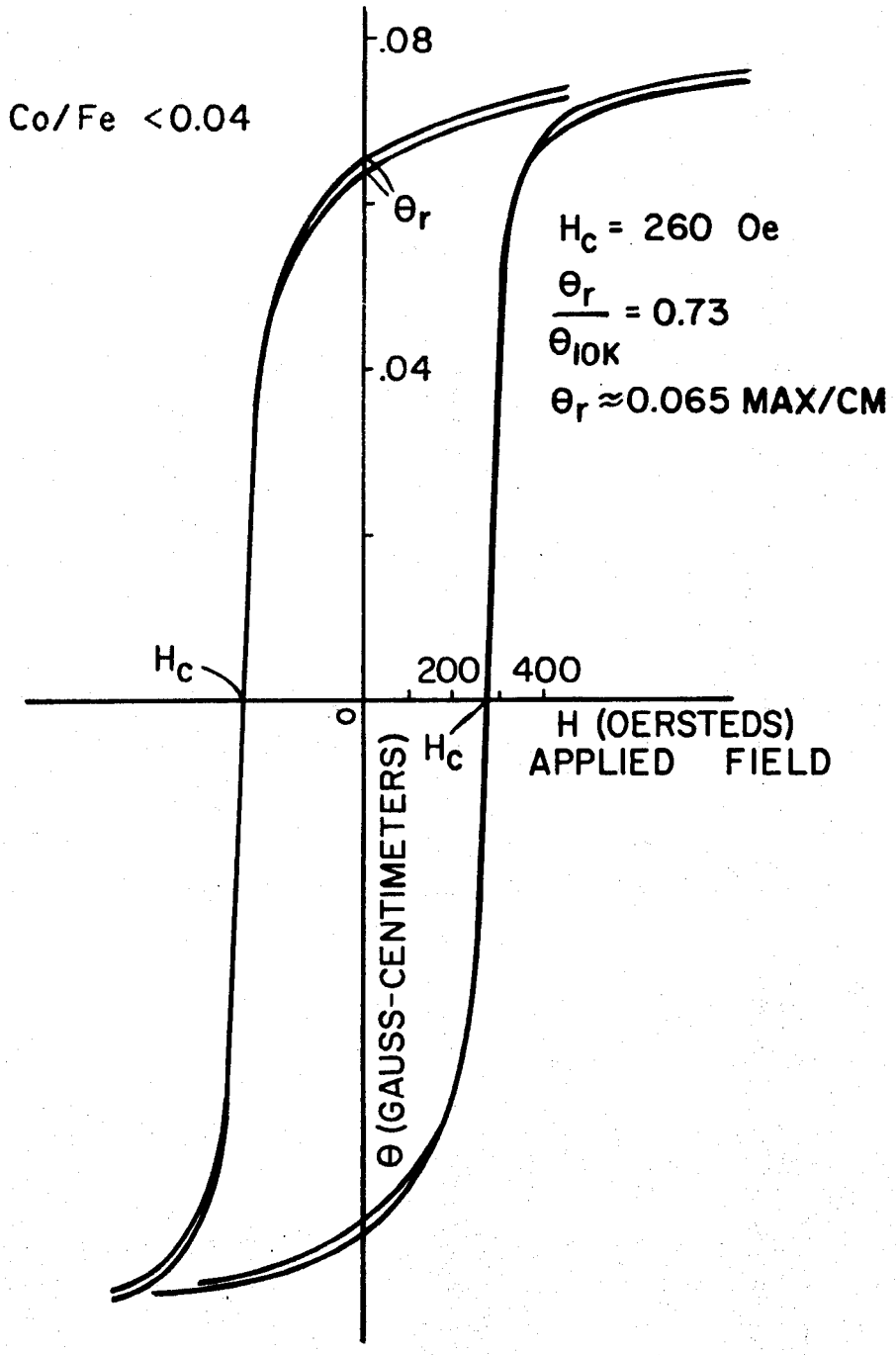
FIGS. 3–6 are diagrams showing the major parallel and perpendicular hysteresis loops of four magnetic devices having cobalt substituted magnetite films improved by the method of the present invention.
Figure 4:
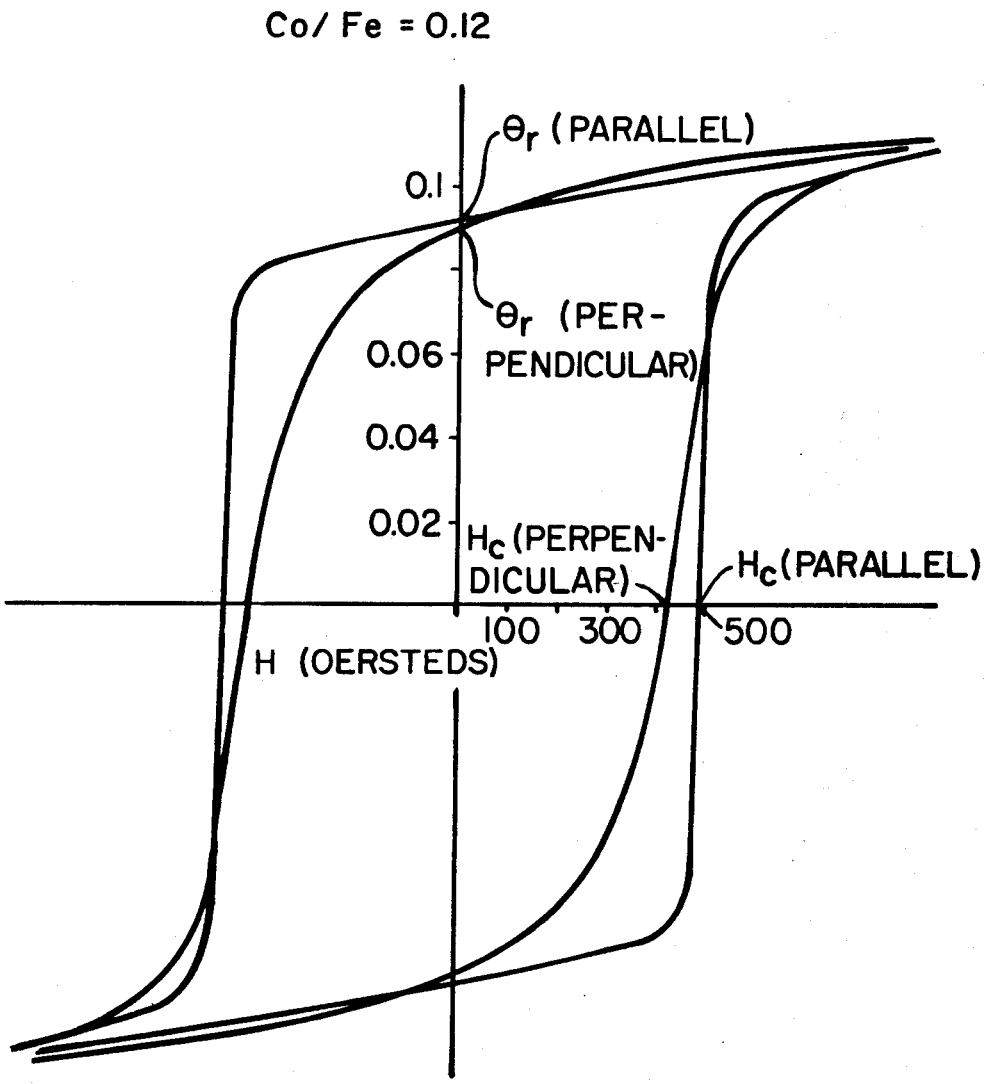

As heretofore noted, the cobalt to iron ratio of cobalt substituted magnetite directly affects some of the magnetic characteristics of the material. Referring to FIG. 2, it is seen that the coercivity of a cobalt substituted magnetite film increases and the hysteresis loop squareness ratio decreases as the cobalt to iron ratio increases. The reasons for these changes are not clear. It is believed, however, that the cobalt to iron ratio in the ferromagnetic phase of the film is less than the overall ratio, and that excess cobalt may exist as a second non-ferromagnetic oxide phase or in clusters of paramagnetic material. The presence of either non-ferromagnetic oxide or paramagnetic cobalt clusters would reduce the squareness ratio. If the cobalt substituted magnetite film was reduced in a reduction atmosphere of hydrogen and water as heretofore described, it is believed, based upon the fact that metallic cobalt is more stable than cobalt oxide under such reduction conditions, that cobalt clusters are likely to be the cause of the low squareness ratio.

The method of this invention will improve both the coercivity and hysteresis loop squareness ratio of cobalt substituted magnetite. The term "hysteresis loop squareness ratio" when used herein means remanence, $\theta_4$, divided by the magnetization occuring when a field of 10,000 oersteds is applied, $\theta_{10k}$. That is, hysteresis loop squareness ratio $= \theta_r/\theta_{10k}$.

FIGS. 3, 4, 5 and 6 show the hysteresis loops of four samples having different cobalt to iron ratios after a 147 hour annealing at about 150°C in air. Prior to the annealing, these samples were magnetized to substantially the saturation level in a field of 7500 oersteds. FIGS. 3, 4, 5 and 6 each contain two hysteresis loops. One of the hysteresis loops results when the present device is subjected to a field parallel to the magnetization field which was applied before annealing, and the second loop results when the device is subjected to a field perpendicular to the magnetization field applied before annealing. Hereinafter, the hysteresis loop resulting from parallel magnetization and the hysteresis loop resulting from perpendicular magnetization will be referred to as the parallel and perpendicular loops respectively. The parallel and perpendicular loops are quite different except in FIG. 3, where they almost coincide with each other. The parallel loop has a much higher squareness ratio and coercivity than does the perpendicular loop.

Figure 5:
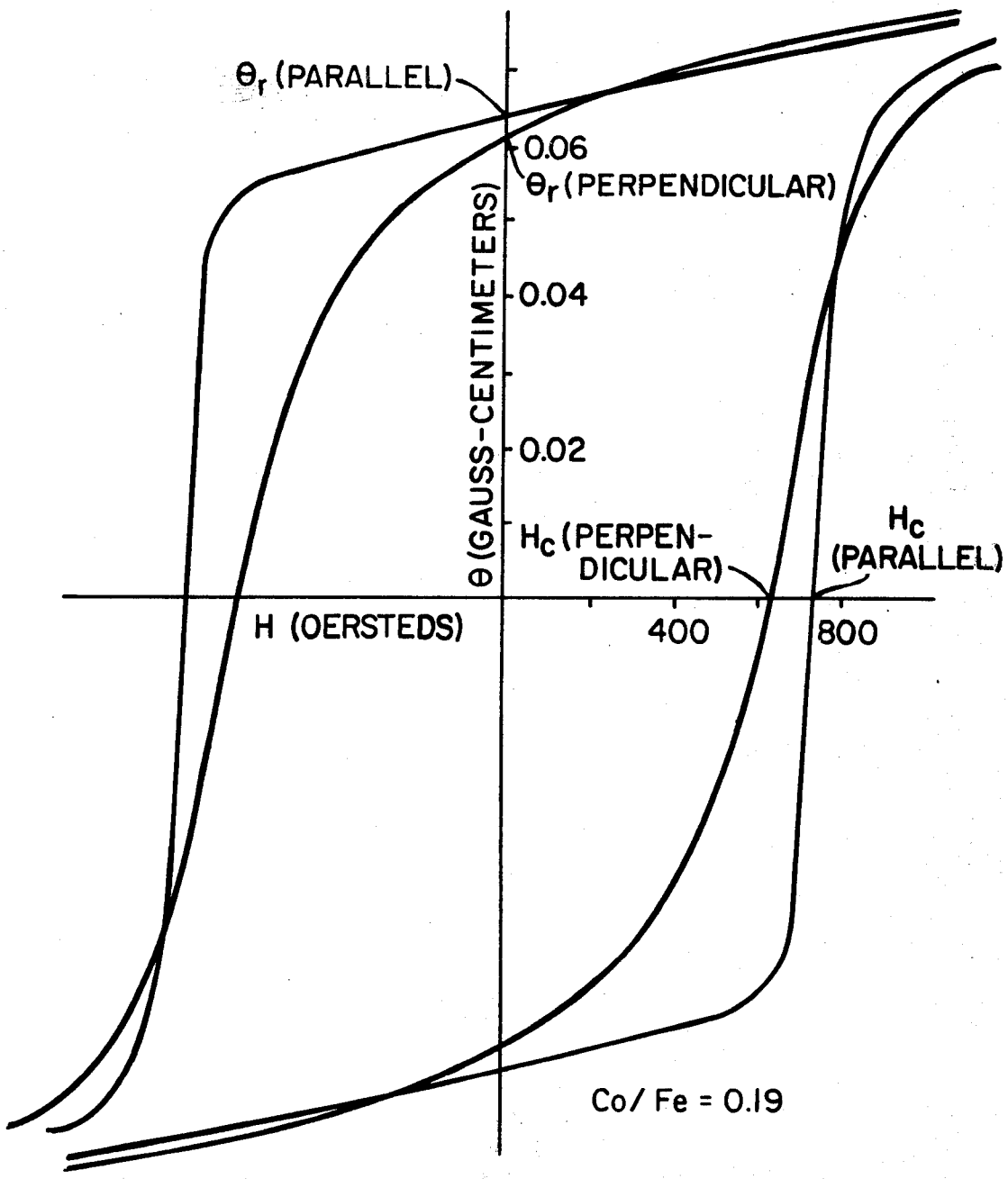
Figure 6:
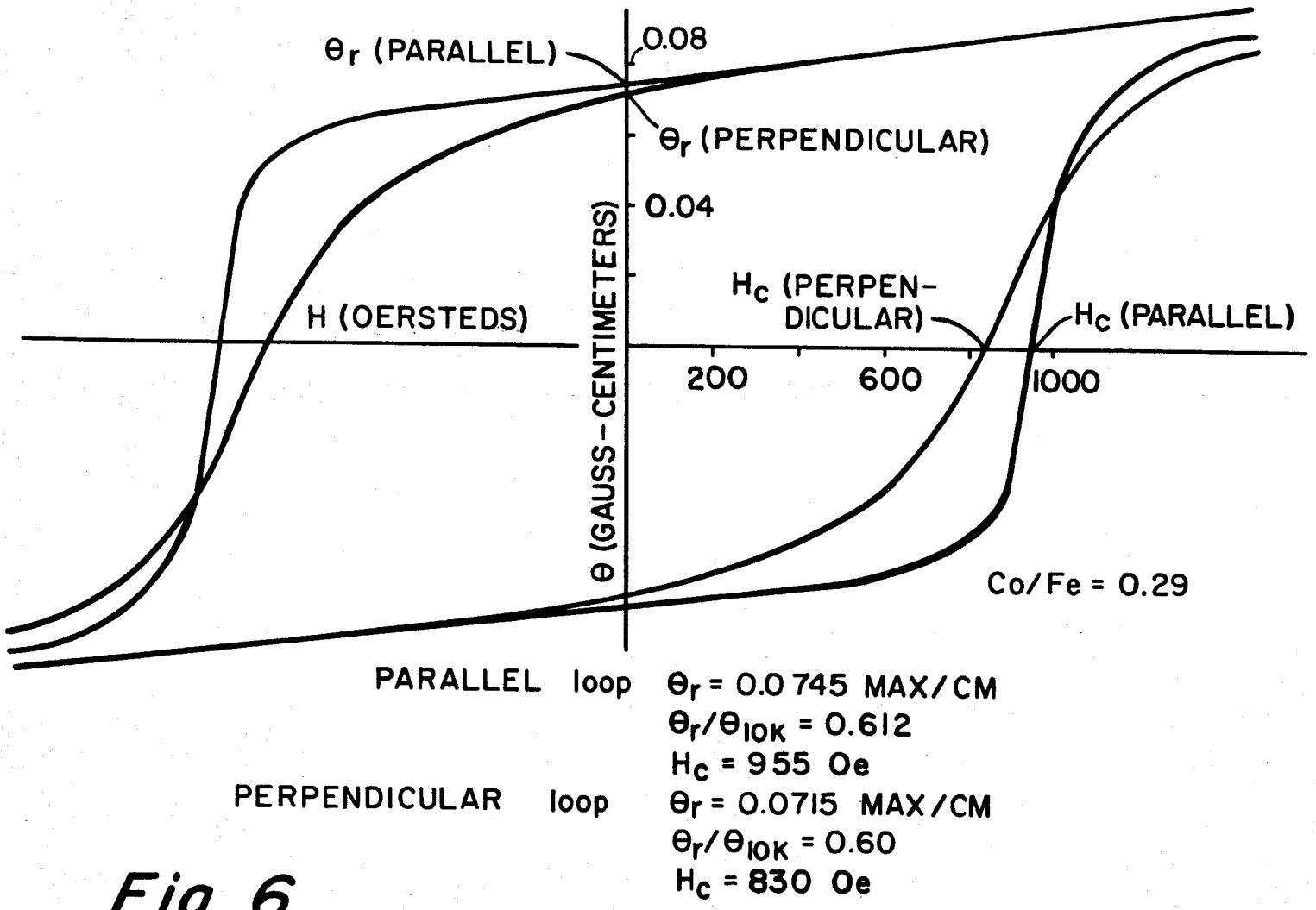

FIG. 1 illustrates the hysteresis loop of an untreated cobalt substituted magnetite film having a cobalt to iron ratio of 0.21. FIG. 5 illustrates the hysteresis loop of a treated cobalt substituted magnetite film having a ratio of 0.19. Although the cobalt to iron ratios are not identical, they are close enough to illustrate the improvement in the coercivity and hysteresis loop squareness ratio which results when the magnetic devices are treated in accordance with the present invention. The cobalt to iron ratio in the untreated film illustrated by FIG. 1 is higher than the cobalt to iron ratio of the treated film illustrated by FIG. 5, yet the film illustrated by FIG. 5 has significantly higher coercivity. In addition, the parallel and perpendicular hysteresis loops have a significantly higher squareness ratio than does the hysteresis loop of the untreated film.

Figure 7:
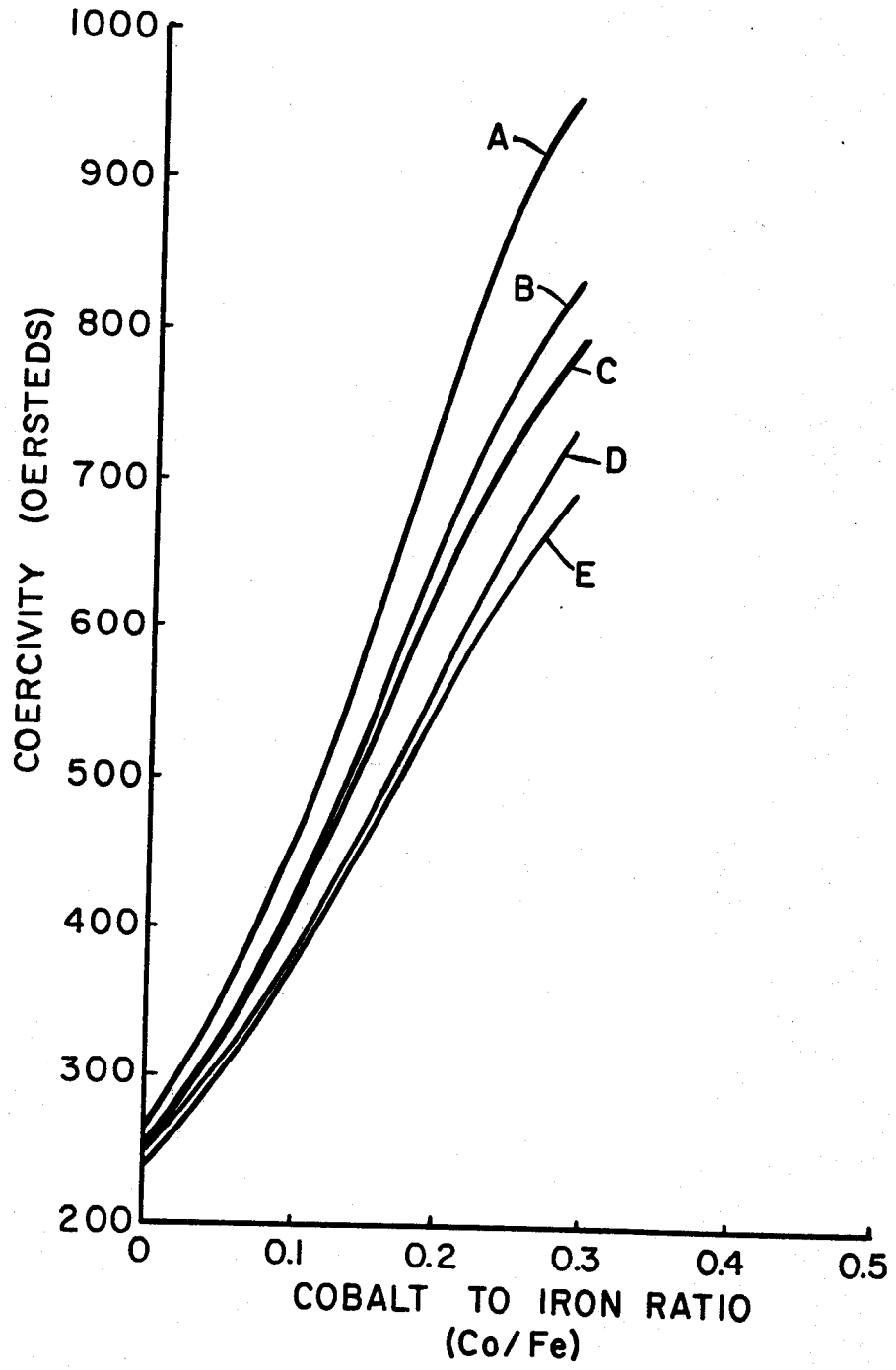
FIGS. 7 and 8 are diagrams showing the relationship between coercivity and the cobalt to iron ratio of magnetic devices having cobalt substituted films.
Figure 8:
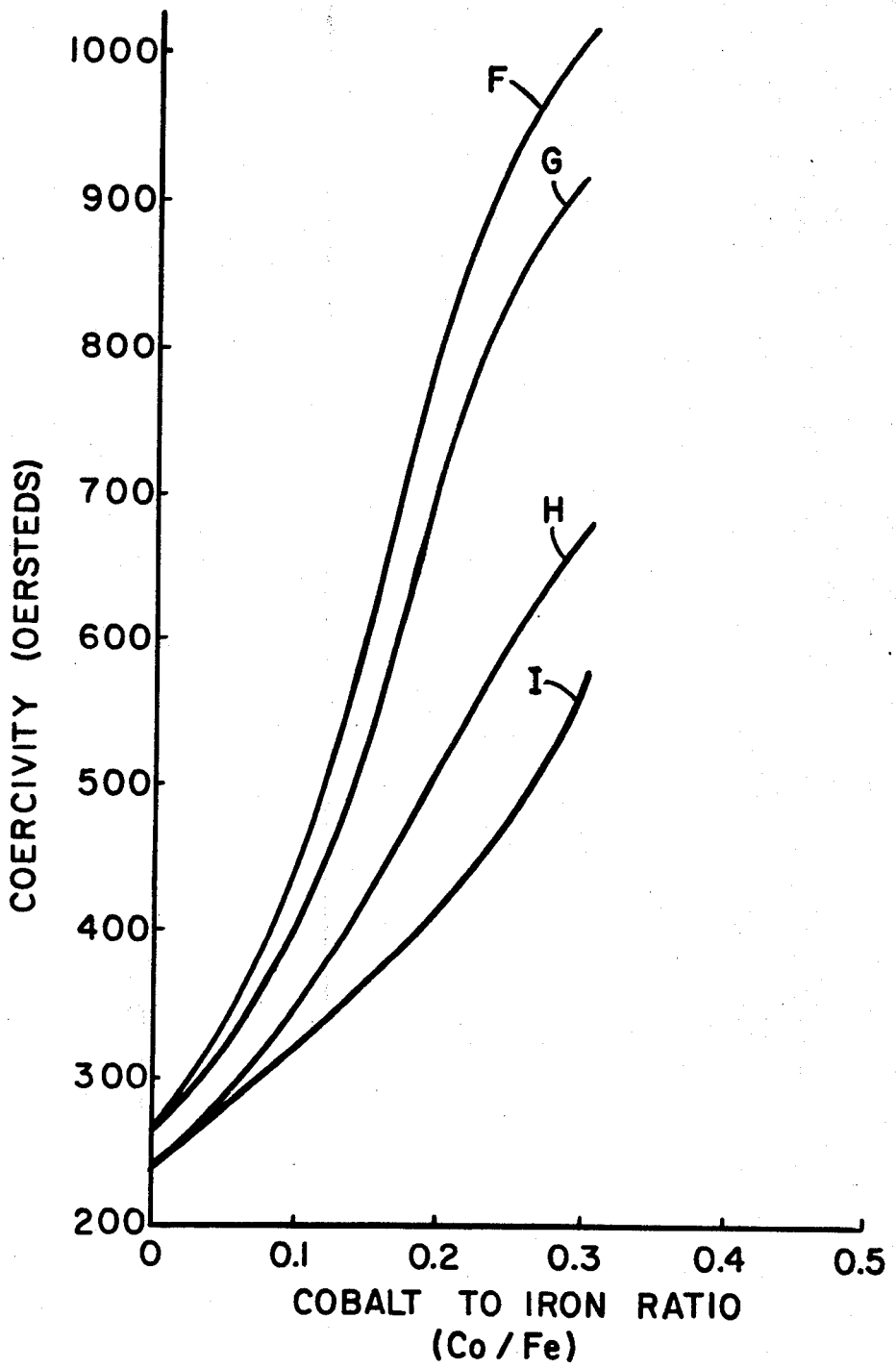
Figure 9:
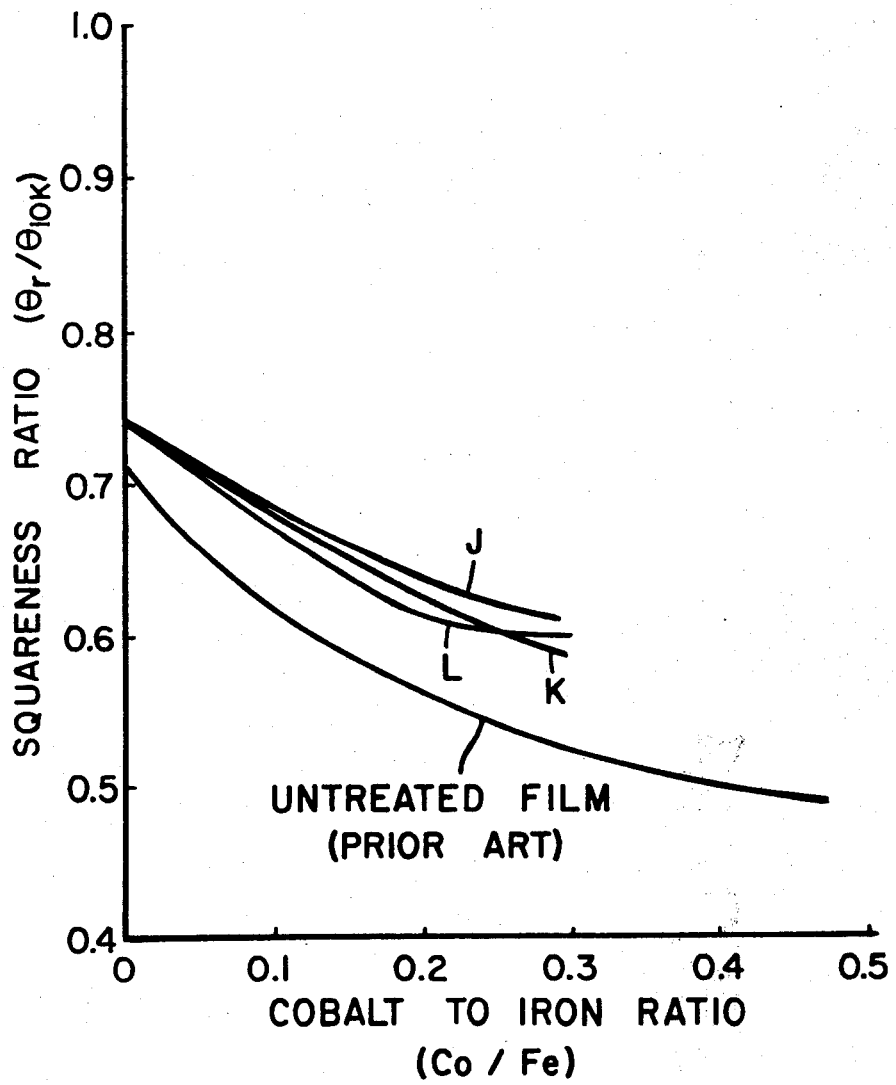
FIG. 9 is a diagram showing the relationship between the hysteresis loop squareness ratio and the cobalt to iron ratio of magnetic devices having cobalt substituted magnetite films.
Figure 10:
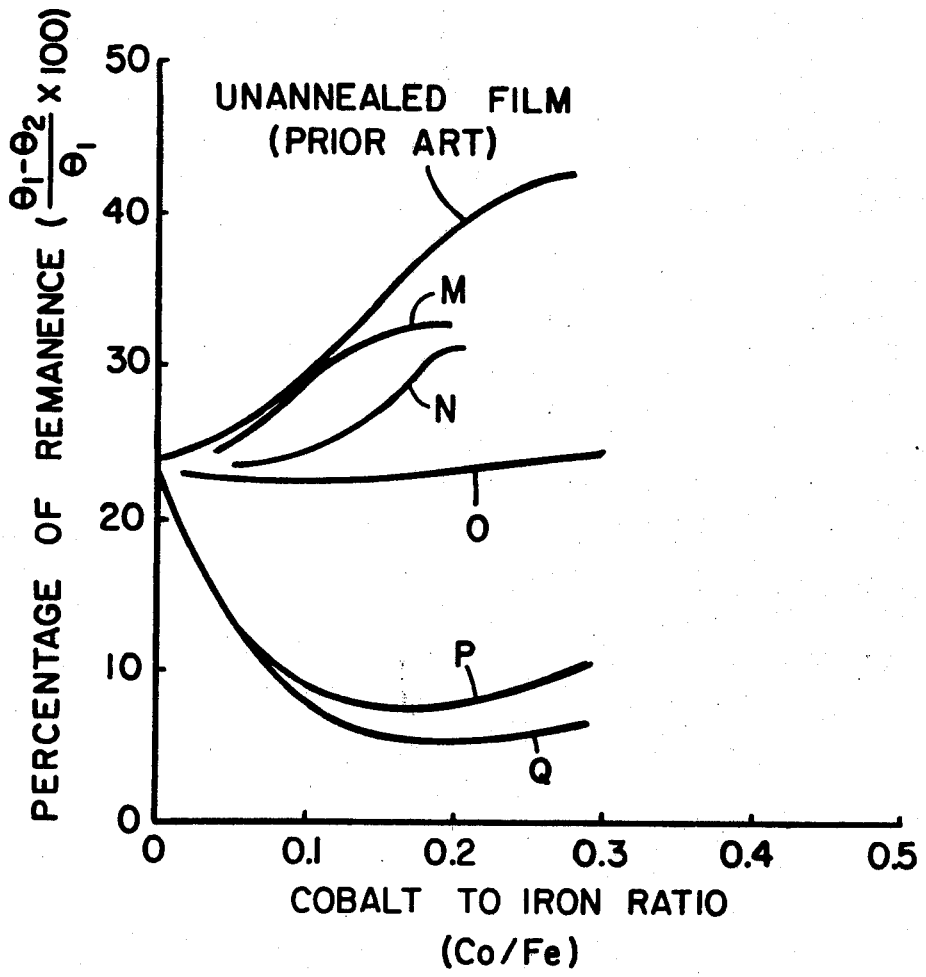
FIG. 10 is a diagram showing the relationship between the loss of remanence in cobalt substituted magnetite films due to external forces, and the cobalt to iron ratio.

Graphs which illustrate the coercivity and squareness ratio for some films annealed under different conditions are shown in FIGS. 7, 8 and 9. FIG. 7 illustrates the effect of the cobalt to iron ratio on the coercivity of films annealed at 150°C according to the method of this invention for different periods of time. FIG. 8 illustrates the effect of the cobalt to iron ratio on the coercivity of films annealed at different temperatures and for different periods of time. FIG. 9 illustrates the effect of the cobalt to iron ratio on the hysteresis loop squareness ratio of films annealed at 150°C for different periods of time. FIG. 10 illustrates the effect of the cobalt to iron ratio on the amount of remanence loss due to abrasion and other external forces upon films annealed at about 150°C for different periods of time. The content of FIGS. 7 through 10 are summarized in Table II.

Table II

| FIG. | Curve | Annealing Temp. °C | Annealing Time Hrs. | Magnetization Direction |
|---|---|---|---|---|
| 7 | A | 150 | 147 | Parallel |
| 7 | B | 150 | 82 | Parallel |
| 7 | C | 150 | 18 | Parallel |
| 7 | D | 150 | 82 | Perpendicular |
| 7 | E | 150 | 18 | Perpendicular |
| 8 | F | 200 | 2 | Parallel |
| 8 | G | 200 | 2 | Perpendicular |
| 8 | H | 95 | 177 | Parallel |
| 8 | I | 95 | 177 | Perpendicular |
| 9 | J | 150 | 147 | Parallel |
| 9 | K | 150 | 18 | Parallel |

Table II-continued

| FIG. | Curve | Annealing Temp. °C | Annealing Time Hrs. | Magnetization Direction |
|---|---|---|---|---|
| 9 | L | 150 | 147 | Perpendicular |
| 10 | M | 150 | 18 | Perpendicular |
| 10 | N | 150 | 82 | Perpendicular |
| 10 | O | — | — | Not Magnetized |
| 10 | P | 150 | 18 | Parallel |
| 10 | Q | 150 | 82 | Parallel |

The effects of these different annealing conditions can be summarized as follows: (A) The coercivity and the squareness ratio for both the parallel and perpendicular loops of an annealed film are higher than those for a non-annealed sample with a comparable cobalt to iron ratio. (B) Films annealed at high temperatures have higher coercivity than those annealed at lower temperatures. (C) The coercivity of the material is significantly higher when magnetized parallel to the initial magnetic field than when the material is magnetized perpendicular to the initial magnetic field. (D) Films annealed at lower temperatures seem to have a slightly higher squareness ratio than those annealed at higher temperatures.

The improvement of the coercivity and hysteresis loop squareness ratio as a result of the present treatment may be explained if the likely possibility that the cobalt substituted magnetite film was not microscopically homogeneous is assumed. If such nonhomogeneity existed, it may further be assumed that a homogenization process went on during the heat treatment, and that some of the paramagnetic cobalt clusters diffused to form either ferromagnetic oxide or both ferromagnetic oxide and nonmagnetic iron oxide. Both the normal cubic anisotropic constant and the uniaxial anisotropic constant could increase as a result of such a homogenization process and the increase in ferromagnetic oxide. A decrease in a number of paramagnetic clusters and an increase in the cubic and uniaxial anisotropic constants would increase both the hysteresis loop squareness ratio and the coercivity of the film.

A third and very important improvement of the magnetic properties of a treated cobalt substituted magnetite film is that the tendency to lose remanence due to abrasion or to other types of external forces is greatly reduced. The tendency to lose remanence due to external forces appears to increase as the cobalt to iron ratio in the film increases, and such increase is probably due to the increase of the magnetostriction constant. However, after the magnetic properties of a film have been improved by the method of the present invention, the tendency to lose remanence due to externally applied forces becomes highly dependent upon the direction of magnetization with respect to the induced uniaxial anisotropy. For example, when a film is magnetized in the same direction as the induced uniaxial anistropy, the remanence loss due to external forces is much less than when the treated film is magnetized perpendicular to the direction of the induced uniaxial anisotropy. If the film was annealed without being initially magnetized, the tendency to lose remanence will be the same no matter in what direction the film is subsequently magnetized, and this loss will be intermediate to that of losses when the film is initially magnetized in either the parallel and perpendicular directions. The results of several samples tested for remanence losses are shown in FIG. 10. The values $\theta_1$ and $\theta_2$ represent the remanence before and after external forces were applied respectively. Therefore, the percentage of remanence loss is equal to $$\frac{100(\theta_1 - \theta_2)}{\theta_1}.$$

Even though cobalt substituted magnetite material has a high magnetostriction constant, the high loss of remanence occuring in films magnetized perpendicular to the initial magnetization is in excess of what would be expected if such losses depended only upon the magnetostriction constant. Therefore, it is believed that the excessive loss of remanence of a cobalt substituted magnetite film may be due to the possibility that the effect of an applied force upon a magnetic material depends not only upon the inherent properties of the material, such as the magnetostriction constant and the anisotropic constant, but also upon the physical state of the material itself. A portion of a single crystal will react to an external force quite differently than will a piece of polycrystalline material or a thin film. The difference arises from mechanical interaction between neighboring particles and between particles and the substrate. A single crystal can change its shape or dimension without producing internal strain. In a polycrystalline material or thin film, however, the situation is quite different. Since the crystals are tightly bound to the substrate and tightly packed against each other, they can no longer change their shape and dimensions freely. Therefore, when a film is cooled down from the high temperature at which it was formed, the magnetization in each crystal will be oriented in a direction such that the total energy of the film as a whole will be minimum. This total energy includes the crystalline anisotropic energy, magnetostriction energy, and elastic energy. When the film is magnetized, an internal strain will be created which will increase the total energy of the film because the crystals are not free to change their dimensions. This type of internal strain, although negligible in some material, is not negligible in cobalt substituted magnetite, and is believed to be responsible for the high loss in remanence when an external force is applied to a non-annealed sample. However, if the magnetized film is annealed, some of the internal strain is believed to be relieved. Consequently, when the film is subsequently magnetized in the same direction as the initial magnetization, internal strain is much less than it would be if the film was subsequently magnetized in a direction perpendicular to the initial magnetization. The difference in internal strain is believed to explain why the loss in remanence varies so greatly with the direction of magnetization.

SPECIFIC EXAMPLE

A film of non-magnetic cobalt-iron oxide was deposited on an ion-exchange strengthened glass substrate by the chemical vapor deposition process. The disk shaped substrate, had a thickness of 0.08 inch, an outside diameter of 14 inches, and a center hole diameter of 6⅝ inches. The substrate was heated to approximately 450°C while being subjected to vapors of cobalt nitrosyltricarbonyl and iron pentacarbonyl. The ratio of cobalt nitrosyltricarbonyl to iron pentacarbonyl was about 0.2:1. The vapors were delivered to the substrate until an approximately 3000 A thickness film of non-magnetic cobalt-iron oxide was deposited thereon. The film was then reduced to cobalt substituted magnetite by being subjected to a water and hydrogen atmosphere at 450°C for 1½ hours. An atmosphere having a hydrogen partial pressure to water partial pressure ratio of about 2.4:1 was used for reducing the film. The atmosphere was obtained by bubbling a mixture of 8 percent by volume of hydrogen and 92 percent by volume of nitrogen through water, while said hydrogen, nitrogen and water were maintained at approximately 25°C. The magnetic device was then magnetized to the saturation level with a circumferential orientation. The magnetic device was then annealed in air at 150°C for 147 hours. FIG. 5 illustrates the parallel and perpendicular hysteresis loops obtained from the device of this example.

Although the present invention has been described with respect to specific details of certain embodiments thereof, it is not intended that such specific details be limitations upon the scope of the invention except insofar as is set forth in the following claims.

We claim:

1. A method of improving magnetic properties of a magnetic material comprising the steps of providing a quantity of magnetic material comprising at least one phase thereof cobalt substituted magnetite material having a cobalt to iron ratio of between about 0.0345 and about 0.665, subjecting said material to a magnetic field having sufficient field strength and an orientation to magnetize said material in a desired direction, removing said material from said magnetic field, said material retaining a remanent level of magnetization in said desired direction, and thereafter annealing said magnetized material at a temperature between about 95°C and about 200°C in an atmosphere non-reactive with said material for a period of time sufficient to increase the hysteresis loop squareness ratio of said material.

2. The method of claim 1 wherein said cobalt substituted magnetite material has a cobalt to iron ratio of between about 0.1 and about 0.25.

3. The method of claim 1 wherein said magnetic field strength is sufficient to magnetize said material to the saturation level.

4. The method of claim 1 wherein said annealing is performed at a temperature between about 150°C and about 160°C.

5. The method of claim 1 wherein said material is annealed for at least about two hours.

6. The method of claim 1 wherein said material is annealed for a period of time bertween about 2 hours and about 147 hours.

7. The method of claim 1 wherein said annealing is performed in air.

8. The method of claim 1 wherein said cobalt substituted magnetite material has a cobalt to iron ratio of between about 0.3 and about 0.5, said magnetic field strength is sufficient to magnetize said material to the saturation level, and said annealing is performed at a temperature between about 150°C and about 160°C for a period of time between about 2 hours and 147 hours.

9. A method of improving the magnetic properties of a cobalt substituted magnetite material comprising the steps of providing a quantity of cobalt substituted magnetite material having a cobalt to iron ratio of at least 0.0345, subjecting said material to a magnetic field having sufficient field strength and an orientation to magnetize said material in a desired direction, removing said material from said magnetic field, said material retaining a remanent level of magnetization in said desired direction, and thereafter annealing said magnetized material at a temperature between about 95°C and about 200°C in an atmosphere non-reactive with said material for a period of time sufficient to increase the hysteresis loop squareness ratio of said material.

10. The method of claim 9 wherein said material is annealed for at least about 2 hours.

11. The method of claim 10 wherein said magnetic field strength is sufficient to magnetize said material to the saturation level.

* * * * *